United States Patent [19]

Matalis et al.

[11] Patent Number: 4,729,802

[45] Date of Patent: Mar. 8, 1988

[54] OPENER-DISK HEAT-TREATING PROCESS AND PRODUCT

[75] Inventors: John A. Matalis, Lombard; Thomas Watmough, Flossmoor, both of Ill.

[73] Assignee: J. I. Case Company, Racine, Wis.

[21] Appl. No.: 819,369

[22] Filed: Jan. 16, 1986

[51] Int. Cl.[4] ..... C21D 9/00

[52] U.S. Cl. ..... 148/145; 148/150; 148/152; 148/320; 148/902; 148/903; 148/910; 172/604; 172/747

[58] Field of Search ..... 148/145, 146, 147, 150, 148/151, 152, 39; 172/604, 747

[56] References Cited

U.S. PATENT DOCUMENTS

| | | | |
|---|---|---|---|
| 3,532,333 | 10/1970 | Dehn | 148/150 |
| 3,558,367 | 1/1971 | Eck | 148/146 |
| 3,592,702 | 7/1971 | Dehn | 148/144 |
| 3,592,703 | 7/1971 | Dehn et al. | 148/147 |
| 3,647,577 | 3/1972 | Gomada et al. | 148/150 |
| 3,703,093 | 11/1972 | Komatsu et al. | 148/12 |
| 3,741,821 | 6/1973 | Athey et al. | 148/13.1 |
| 3,751,018 | 8/1973 | Partyka et al. | 148/152 |
| 3,753,789 | 8/1973 | Kucera et al. | 148/146 |
| 3,815,395 | 6/1974 | Sass | 72/342 |
| 3,943,999 | 3/1976 | Lely et al. | 148/39 |
| 4,120,187 | 10/1978 | Mullen | 148/130 |
| 4,167,846 | 9/1979 | Shaw et al. | 148/145 |
| 4,212,900 | 7/1980 | Serlin | 148/127 |
| 4,280,566 | 7/1981 | Breen | 148/39 |
| 4,305,272 | 12/1981 | Johnson | 148/148 |
| 4,312,685 | 1/1982 | Riedl | 148/146 |
| 4,486,240 | 12/1984 | Sciaky | 148/152 |

*Primary Examiner*—R. Dean

*Attorney, Agent, or Firm*—Dressler, Goldsmith, Shore, Sutker & Milnamow, Ltd.

[57] ABSTRACT

A process for increasing surface hardness of a heat-hardenable steel disk, along an annular band intermediate the disk central and edge portions, is disclosed. The process contemplates selecting a first position on the surface of the intermediate annular band. The process contemplates next rapidly heating at the first position a minor portion of the disk surface in relation to the remainder of the disk so as to cause the minor portion to increase in temperature to an elevated temperature ranging from 1400 to 1600 degrees Fahrenheit in a time period of 0.3 to 0.7 seconds. The disk is heated in a manner such that substantially no heat diffuses from the thus-heated portion of the disk to the remainder thereof. The process next contemplates rapidly terminating the heating step to allow the remainder of the steel disk to serve as a heat sink to rapidly cool the thus-heated portion from the elevated temperature to less than 1000 degrees Fahrenheit in 0.75 seconds, and such that warpage of the steel disk is held to within 0.030 inches over the surface of the disk. The process next contemplates selecting a second position spaced from the first position along the annular band, and repeating the rapid-heat and heat-termination stops. Lastly, the process contemplates repeating the position-selection through heat-termination steps until a major portion of the annular band is increased in hardness to at least 50 $R_c$ to a depth of at least 0.015 inches.

15 Claims, 14 Drawing Figures

FIG. 1
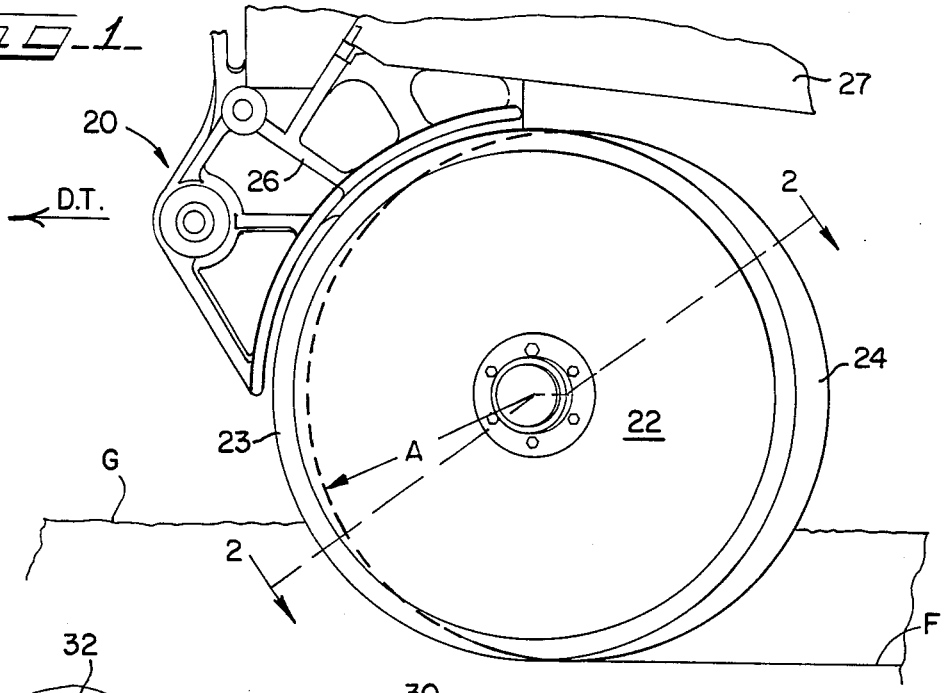
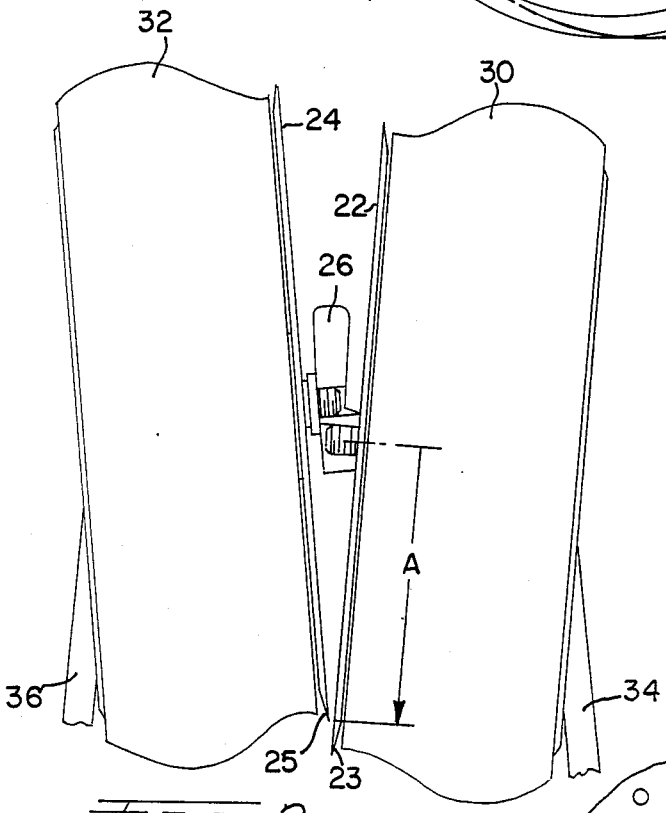
FIG. 2
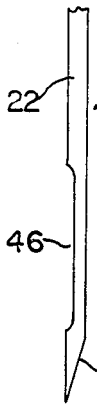
FIG. 3
(PRIOR ART)
FIG. 4
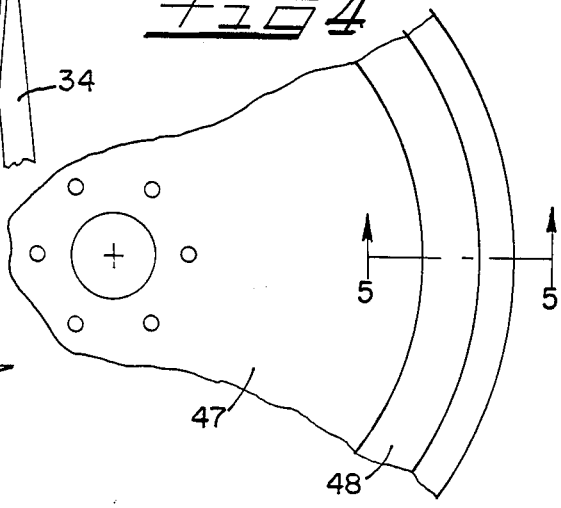
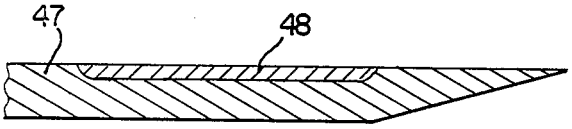
FIG. 5

OPENER-DISK HEAT-TREATING PROCESS AND PRODUCT

TECHNICAL FIELD OF THE INVENTION

The present invention is directed to heat-treating processes for metallic, heat-hardenable planar soil-opener disks.

More particularly, the present invention is directed to several selected heat-treating processes, each of which hardens an annular band adjacent the circumference of a metallic, heat-hardenable planar soil-opener disk. Further, the present invention is directed to the heat-hardened disk produced by each one of the heat-treating processes disclosed and claimed herein.

BACKGROUND OF THE INVENTION

Conventional seed planters include soil-opener mechanisms for forming furrows in the soil. Such furrows can be formed by a pair of planar disks independently rotatably mounted on the seed planter in a manner so as to cause these disks to penetrate the soil and co-act to form a single furrow as the planter moves across the ground. In a typical arrangement, the disks are mounted on the implement in a skewed manner, one disk skewed relative to the other disk, such that the disks together take on a V-shape to form a single furrow. The "point" of the "V" is disposed forward of the disk centers relative to the disk direction of travel. Further, one disk (the so-called "leading" disk) is typically spaced ½ to 1 inch ahead of the other disk (the so-called "trailing" disk) relative to their direction of travel and respective disk centers. Both disks are typically disposed the same depth into the ground. Planting is typically performed with the seed-planter implement traveling through a field at a speed of about three miles per hour (MPH). Each disk is typically 14 inches in diameter and is thus caused to rotate about seventy-two revolutions per minute (RPM).

Preferably, the disks are gapped by as much as 3.2 millimeters at the "point" of the "V" to avoid one disk contacting the other. However, as the disks engage the soil they are caused to deflect and contact each other. Because the circumferential disk portions which contact at the "point" of the "V" move relative to each other, the trailing disk will wear a 1-inch wide annular groove into the leading disk, the groove being spaced about ½ inch from the leading disk circumference. Such wear may be so severe that the leading disk must be replaced daily. This, of course, involves undesired cost and can result in excessive non-productive activity.

Affixing hard-facing material and/or applying hard-facing coatings at the disk-wear area are currently not economically practical.

A process for heat-treating agricultural-implement metal disks so as to obtain a metal disk having a hardened surface-area portion is disclosed in U.S. Pat. No. 4,305,272 to Johnson. The method disclosed and claimed as invention in the Johnson patent, however, is entirely different from the present invention discussed hereinbelow. Briefly, the Johnson disks are tempered after being quenched (i.e. cooled), whereas the disks of the present invention are rapidly cooled, and not tempered thereafter. Also, because the '272 Johnson disk is a soil-tilling disk, and has a generally non-planar shape in cross section, slight warpage of the Johnson disk is acceptable. The disk of the present invention is planar; and thus warpage is generally not acceptable. The method of the present invention, unlike the Johnson method, particularly points out and teaches how to avoid disk warpage, therefore. Finally, the Johnson method teaches a method for producing a disk having a central portion and an annular peripheral portion having greater hardness than the central portion. The present invention, on the other hand, teaches and claims methods for producing a disk having a central portion, an annular peripheral edge portion of hardness equal to the central portion, and a second annular portion spaced between the central portion and the peripheral edge portion and having a hardness substantially greater than the disk central and peripheral portions. That is, Johnson teaches hardening a disk edge, whereas the present invention teaches hardening a disk surface portion that is spaced radially inwardly of the disk edge.

SUMMARY OF THE INVENTION

A process for increasing the surface hardness of a planar, heat-hardenable, mild carbon steel disk along an annular surface portion spaced radially intermediate the circumferential edge and the central portions of the disk is summarized as follows. Preferably, the steel disk is about 14 inches in diameter. The steel disk is preferably composed of AISI (American Iron and Steel Institute) 1070 through 1095 plain carbon steel. More preferably, the disk is selected from the group consisting of AISI 1075, 1080 and 1085 and has an initial surface hardness ranging from about 42 to about 47 Rockwell "C" ($R_c$) hardness. The disk is preferably 3.0 to 3.5 millimeters thick. To increase the surface hardness of the intermediate annular surface portion to a hardness value greater than the circumferential edge and central surface portion hardness, the process first contemplates selecting a first position on the intermediate annular surface. Next, the process includes rapidly heating, at the first position, a minor portion of the disk surface in relation to the remainder of the disk. A "minor portion" of the disk surface is herein referred to as less than 50% of the disk surface, preferably less than 5% of the disk surface, and more preferably less than 0.5% of the disk surface. The rapid heating step is performed so as to cause the minor disk portion, initially at the same temperature as the disk, to rapidly rise to an elevated temperature ranging from about 1400 to 1600 degrees Fahrenheit. Generally the disk is initially at room temperature, i.e., about 25 degrees Centigrade (about 77 degrees Fahrenheit). In particular, the disk is then preferably heated from room temperature to a temperature ranging from about 1400 to about 1600 degrees Fahrenheit, in a time period ranging from about 0.3 to about 0.7 seconds. Further, the rapid heat-rise step is performed in a manner whereby substantially no heat diffuses from the thus-heated disk portion to the remainder of the disk. The heating step is then rapidly terminated in a manner so as to allow the remainder of the steel disk to serve as a heat sink thereby to rapidly cool the thus-heated disk portion from the elevated temperature to a temperature lower than the elevated temperature in less than about 0.75 seconds, and such that warpage of the steel disk is held to within 0.030 inches over the entire disk surface. A "heat sink" is herein defined as a body or substance used for the disposal of heat in the course of a thermodynamic process. The minimal warpage requirement means that the maximum amount of bow at any point on the disk surface must be less than 30/1000 ths of an inch. In particular, the temperature of the thus-heated disk portion is reduced from the 1400 to 1600 degrees Fahrenheit range to less than about 1000 degrees Fahrenheit in less than about 0.75 seconds. Next, a second position spaced from the first position on the intermediate annular surface is selected, and the rapid-heat and rapid heat-termination steps repeated. Lastly, the position-selection through heat-termination steps are repeated until a major portion of the intermediate annular surface is increased in hardness to the desired greater value. A "major portion" is herein defined as more than 50% of the intermediate annular surface. In particular, the position-selection through heat-termination steps are repeated in a manner so as to increase the surface hardness of the intermediate annular surface portion to an excess of 50 $R_c$, more preferably an excess of about 58 $R_c$, to a depth of at least about 0.015 inches. More preferably, the depth is at least about 0.030 inches. Still more preferably, the depth is in excess of 0.035 inches.

BRIEF DESCRIPTION OF THE DRAWINGS

FIG. 1 is a side view of a double-disk soil-opener mechanism;

FIG. 2 is a sectional view taken along the plane 2—2 in FIG. 1, on an enlarged scale relative to FIG. 1;

FIG. 3 is a fragmented sectional view of an edge portion of a prior art disk, on an enlarged scale relative to FIGS. 1 and 2;

FIG. 4 is a fragmented plan view of a disk section hardened using one embodiment of the process of the present invention;

FIG. 5 is a fragmented sectional view taken along the plane 5—5 in FIG. 4, on an enlarged scale relative to FIG. 4;

DETAILED DESCRIPTION OF PREFERRED EMBODIMENTS

Figure 6:
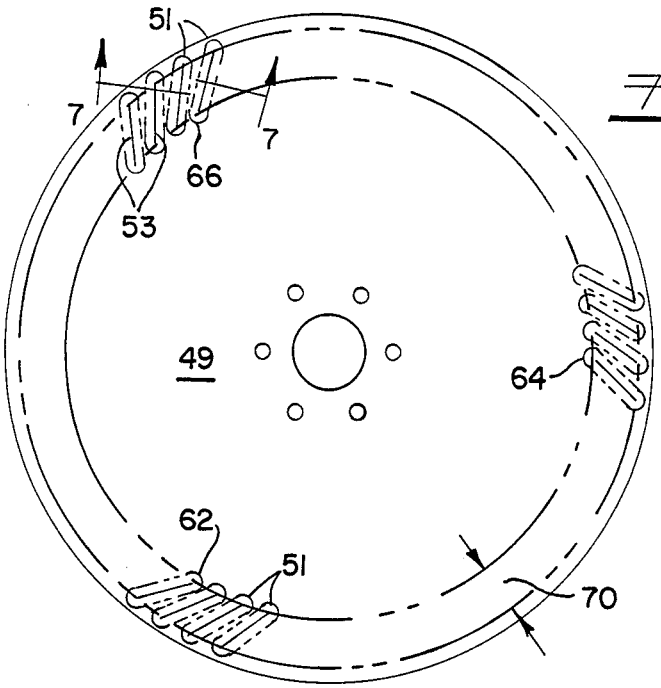
FIG. 6 is a top view of a disk hardened using another embodiment of the process of the present invention.

While the present invention is susceptible to embodiment in various forms, there is shown in the drawings and hereinafter described in detail a number of presently preferred embodiments of the invention, with the understanding that the present disclosure is to be considered as an exemplification of the invention without limitation to the specific embodiments illustrated.

Referring initially to FIG. 1 there is shown a double-disk soil-opener mechanism 20 having a pair of planar, carbon steel disks 22 and 24 independently rotatably mounted on support structure 26. The first or so-called "leading" disk 22 is spaced forward of the second or so-called "trailing" disk 24 by ½ to 1 inch relative to the disk centers in the direction of travel D.T. of an implement 27 relative to the ground G. Each disk 22 and 24 is preferally fourteen inches in diameter. Conventional double-disk soil-opener mechanisms 20 have the leading and the trailing disks 22 and 24 both disposed approximately the same depth downwardly into the soil by biasing means (not shown) to form a single furrow F (FIG. 1). Each disk 22 and 24 typically has a respective beveled circumferential edge portion 23 and 25 (FIG. 2).

Conventional staggered double-disk mechanisms 20 typically have the disks mounted on the support structure 26 in a skewed manner (FIGS. 1 and 2). That is, the axis of rotation of one opener disk is skewed from, and non-coincident with, the axis of rotation of the other disk.

The mechanism 20 includes a pair of tired gauge wheels 30 and 32 for independently respectively gauging the depth of each of the disks 22 and 24 into the ground. The gauge wheels 30 and 32, shown in FIG. 2, are not shown in FIG. 1 to better illustrate the spaced relationship of the disks 22 and 24. The tired wheels 30 and 32 are each bearing mounted on a respective one of a pair of wheel arms 34 and 36. Each wheel arm 34 and 36 is independently pivotally connected to the implement 27. As the implement 27 travels across the ground G, the gauge wheels 30 and 32 ride on the ground and gauge the depth of the associated disks into the ground. Conventional above-mentioned biasing means (not shown), carried by the implement 27, biases the disks 22 and 24 into the ground.

The conventional disks 22 and 24 are relatively disposed so as to form a "V" when viewed from a plane generally passing through the disk centers and disposed toward the ground forward of the disk centers relative to the direction of travel (FIG. 2). That is, the "point" of the "V" is disposed in the direction of travel D.T. (FIG. 1) of the mechanism 20. In conventional mechanisms 20 of this type, the leading and trailing disks 22 and 24 are designed to be gapped at the "point" of the "V" (FIG. 2) by up to about 3.2 millimeters.

Deformation of the disks, together with a minor amount of bearing looseness, however, gives rise to a rubbing action between the disks 22 and 24. The edge 25 of the trailing disk 24 makes a point contact with the backside of the leading disk 23, giving rise to high stress at the point of contact where the edge 25 rubs against a circumferential edge portion of the leading disk 22 which it faces. In particular, the trailing disk circumferential edge 25, shown in FIG. 2, rubs against a portion of the leading disk 22. That portion of disk 22 where edge 25 rubs is spaced from the center of disk 22 by the distance "A". (See FIGS. 1 and 2.) Conventionally, in the "prior art" leading disk 22, this results in the formation of a groove 46 in the backside thereof (FIG. 3). If such surface wear is allowed to continue long enough, the entire outer perimeter of the leading disk 22 tends to become worn away.

Of course, in the case where the leading and trailing disks are designed to make contact along a line (embodiment not shown), such disks, too, will tend to eventually wear away through use with time, and process of the present invention can be used to further extend useful life of disks mounted in such a manner.

The present invention contemplates formation of hardened zones in the annular surface area of the disk subject to wear. The process of the present invention is performed upon heat hardenable metal disks. Such disks, typically AISI (American Iron and Steel Institute) 1070 through 1095, and preferably selected from the group consisting of 1075, 1080 and 1085, carbon steel are about 14 inches in diameter, 3.0 to 3.5 millimeters thick, and have an initial Rockwell hardness ($R_c$) of about 42 to about 47. The process of the present invention contemplates rapidly heating minor portions of the annular area to be hardened to a temperature in excess of 1400 degrees Fahrenheit and rapidly cooling the area. The minor portion of the annulus is heated to a temperature ranging between about 1400 to about 1600 degrees Fahrenheit in a time period of about 0.3 to about 0.7 seconds. Because only a very minor portion of the disk is thus heated, the remainder of the disk serves as a heat sink to rapidly cool the thus-heated portion of the annulus to less than about 1000 degrees Fahrenheit in a time period of less than about 0.75 seconds after termination of the heating step. This results in a major portion of the annular zone having a Rockwell "C" hardness in excess of 50 $R_c$. Preferably, the Rockwell hardness is in excess of 58 $R_c$. Of course, the heating and cooling steps must be performed in a manner which does not compromise the flatness of the disk. The disk warpage is held to within 0.030 inches across the surface of the disk.

A number of examples exemplifying the process of the present invention are briefly set forth below.

EXAMPLE 1

Fourteen-inch diameter heat-hardenable carbon steel disks 47 (FIG. 4) were placed in an electron-beam heat-treating enclosure (not shown). A one-inch wide annular band having a 6 and ½ inch outer radius was heated to a temperature in excess of 1400 degrees Fahrenheit and rapidly cooled. An annular hardened zone 48, about one-inch wide, was thereby formed in the disk (FIGS. 4 and 5). Local heating was used to keep the amount of disk distortion to a minimum, i.e., less than about 0.030 inches across the surface of the disk 47. Production rate was about 30 seconds beam time per disk. For the continuous annular hardened zone 48, the hardness-depth profile is presented below in Table 1.

TABLE I

| DEPTH, INCHES | ROCKWELL HARDNESS, $R_c$ |
|---|---|
| 0.005 | 64.0 |
| 0.010 | 64.5 |
| 0.015 | 63.5 |
| 0.020 | 64.0 |
| 0.025 | 63.0 |
| 0.030 | 58.5 |
| 0.035 | 38.5 |
| 0.040 | 37.5 |

EXAMPLE 2

Figure 7:
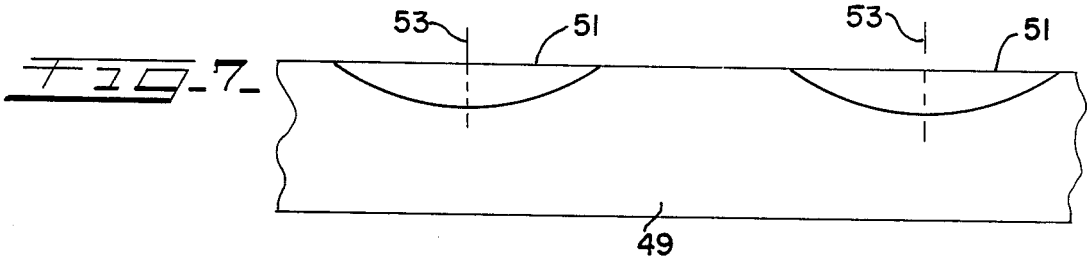
FIG. 7 is a fragmented sectional view taken along the plane 7—7 in FIG. 6, on an enlarged scale relative to FIG. 6.
Figure 8:
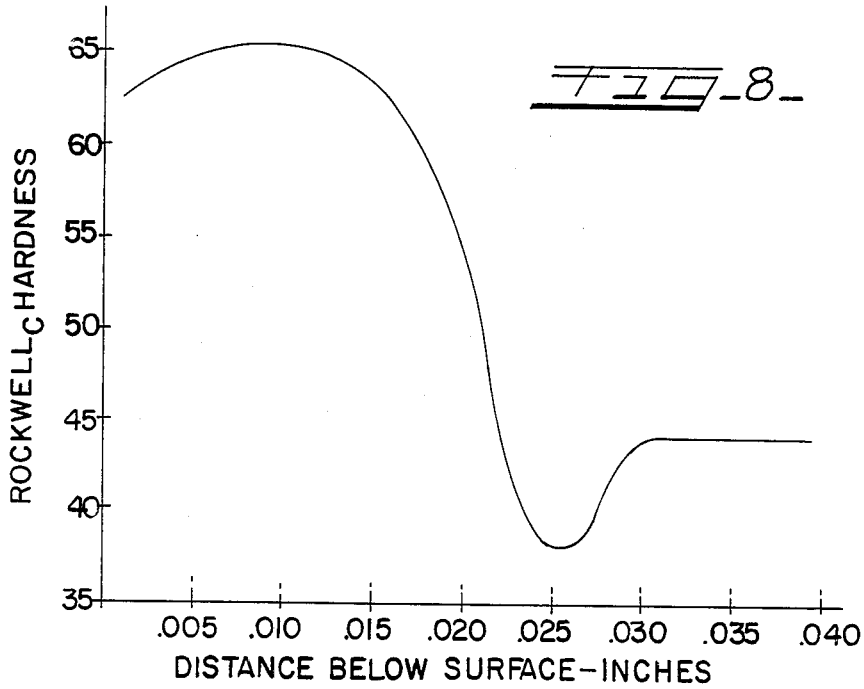
FIG. 8 is a graph illustrating a microhardness traverse through the center line of one of the hardened zones shown in FIG. 7.

Fourteen-inch diameter heat-hardenable carbon steel disks 49 (FIG. 6) were placed in the electron-beam heat-treating enclosure of Example 1. A series of linear angularly-spaced non-radial striped hardened zones 51 were formed within a one-inch wide annular band of the disk as shown in FIG. 6. FIG. 7, a cross section of the heat-treated disk 49 of FIG. 6, shows two of the hardened zones 51. FIG. 8 plots a microhardness traverse through the center line 53 of one of the hardened zones 51 shown in FIG. 7. FIG. 8 shows that the centerline hardness for Example 2 approaches a maximum value of about 65 $R_c$ at a depth of about 0.010 inches below the disk surface. The initial hardness of the disk 49 is presented as being about 44 $R_c$. Between a depth ranging from about 0.023 to about 0.030 inches, the hardness in the annular region is shown as being less than the initial disk hardness. From the surface down to a depth of about 0.015 inches, the hardness is in excess of 60 $R_c$.

Figure 9:
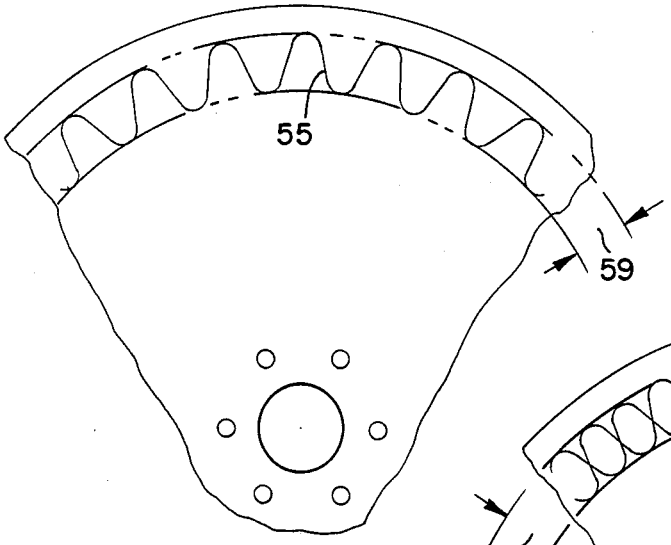
FIG. 9 is a fragmented plan view of a disk section hardened using yet another embodiment of the process of the present invention.
Figure 10:
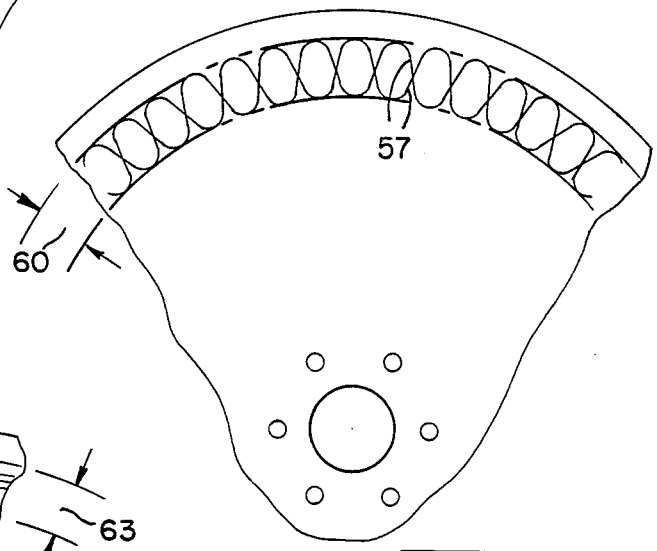
FIG. 10 is a fragmented plan view of a disk section hardened using still another embodiment of the process of the present invention.

While electron-beam heating was used to obtain the effects shown in FIG. 8, other local-heating and hardening techniques such as laser heating, high-frequency electro-magnetic, high-frequency resistance or other high-intensity heating sources can be used to yield a like result. Further, while the first of the above examples illustrates a so-called "continuous" annular band 48 (Example 1), and the second of the above examples illustrates so-called "separated" zones 51 of hardness (Example 2), other patterns such as a sinusoidal stripe 55 (FIG. 9) or an overlapping sinusoidal and co-sinusoidal striped pattern 57 (FIG. 10) will similarly harden the disk portions respectively identified in FIGS. 9 and 10 as being defined by annular regions 59 and 60. Still further, spaced spiral lines 61 (FIG. 11) within the annular region 63 can similarly produce disks 56 having hardened annular regions 63. The sinusoidal lines 55 (FIG. 9), sinusoidal and co-sinusoidal lines 57 (FIG. 10), and spiral lines 61 (FIG. 11) all include hardened zones which surround the lines, similar to the zones 51 shown in FIG. 6, which surround each line 53. Such hardened zones indicate a change in the microstructure of the disk annular surface portion. Although not continuously hardened as Example 1 (FIGS. 4 and 5), the annuli of the above-disk above-discussed disks (FIGS. 9–11) which have hardened zones have been observed to be substantially hardened for the purpose of avoiding disk wear and failure, in accordance with the principle of the present invention. That is, a major portion of the annulus of each has been observed to be hardened. A "major portion" of an annulus is defined as more than 50% of the annulus surface area.

EXAMPLE 3

Figure 12:
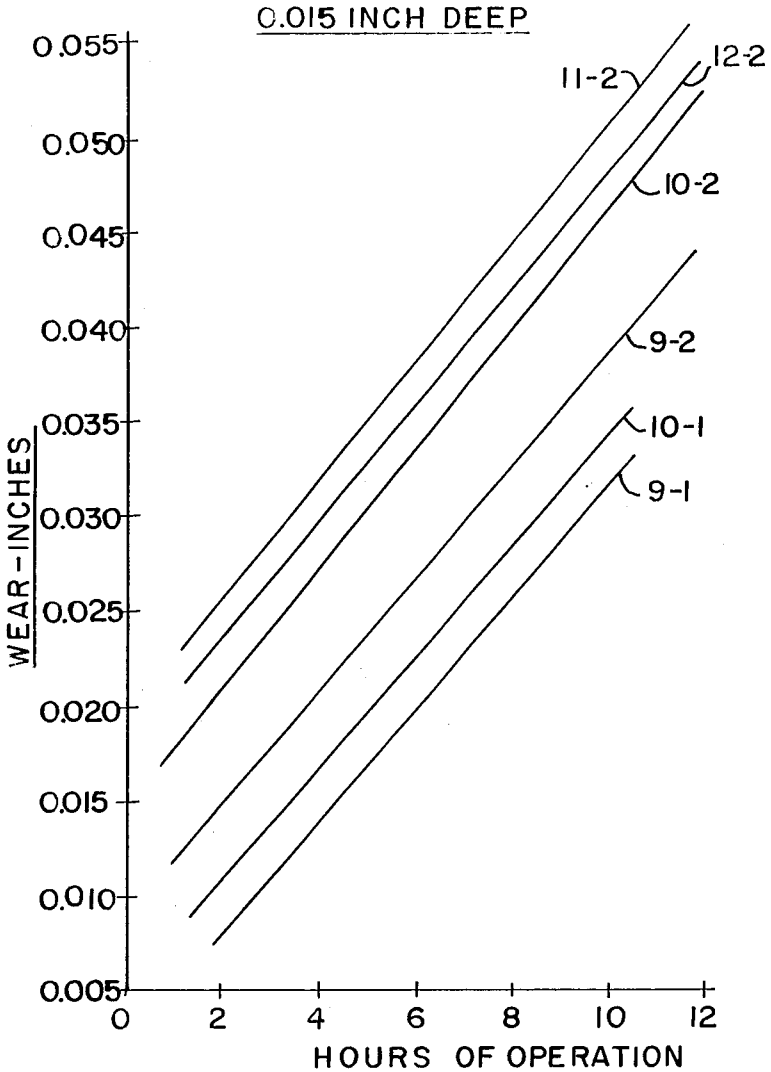
FIG. 12 is a graph which compares wear rates of a number of planter disks.

A series of disks from Examples 1 and 2 were mounted on a planter (not shown); and the planter was used to form furrows through about 500 acres. Graphical presentation of depth of wear in the backside of the leading disks, over time, is summarized in FIGS. 12 and 13. In FIG. 12, so-called "control" disks, that is disks which were not hardened, identified by the lines 11-2 and 12-2, were compared to hard-faced disks, identified by the lines 10-2 and 9-2. Disks hardened according to processes of the present invention were then compared to the "control" and hard-faced disks. Hard faced disks, tested in connection with FIGS. 12 and 13, employed tungsten carbide and nickel chrome hard faces having thicknesses of 0.002 inches, 0.004 inches and 0.006 inches. The line identified as 9-1 (FIG. 12) illustrates the wear rate of a continuous annular hardened surface which results from hardening in an annular pattern, like that of FIGS. 4 and 5, according to Example 1 above. The line identified as 10-1 (FIG. 12) illustrates wear rate of a striped hardened zone pattern similar to that of FIGS. 6 and 7 and formed by the method of Example 2. The depth of hardness for the curves identified as 9-1 and 10-1 is about 0.015 inches. In FIG. 12, the continuous annular hardened surface exhibits the best wear rate of the disks thus tested.

Figure 13:
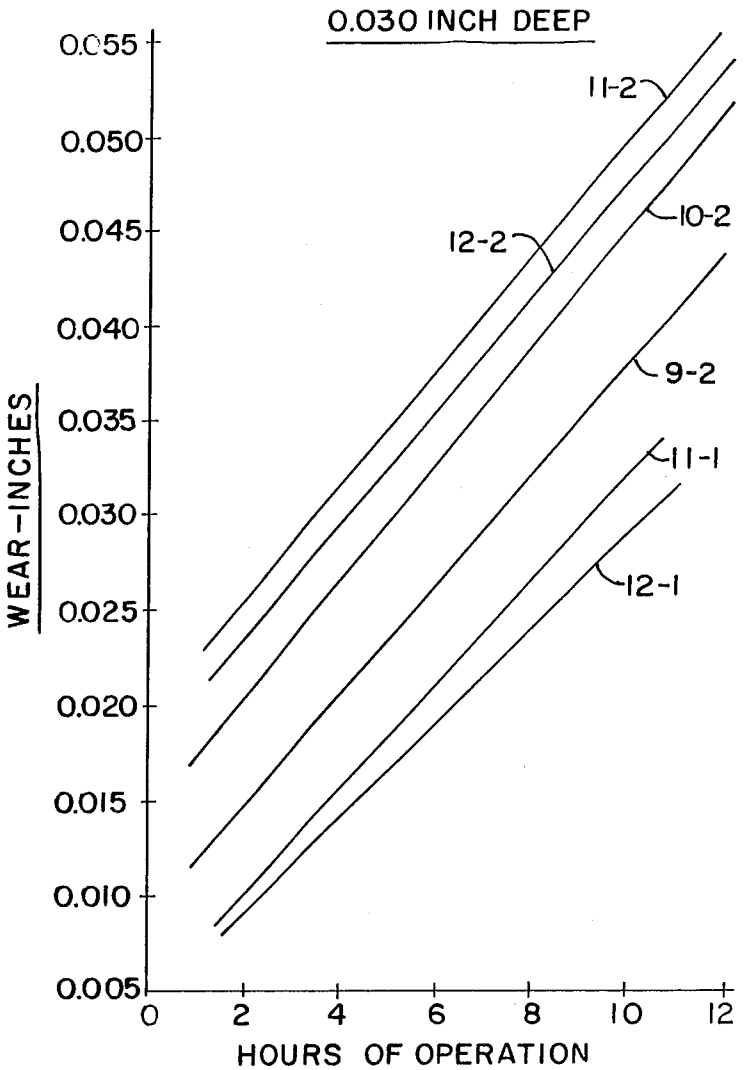
FIG. 13 is a another graph comparing wear rates of planter disks.

In FIG. 13, the depth of hardness is about 0.030 inches. The lines identified as 11-2, 12-2, 10-2 and 9-2 are representative of disks mentioned in connection with explanation of FIG. 12. The continuous annular hardened surface disks are represented by the line identified as 11-1. The annular striped hardened zone pattern disks are represented by the line identified as 12-1. In FIG. 13, the striped hardened zone pattern disks exhibited the best wear rate of the disks tested.

These results indicate that the wear rate is improved significantly, over "control" or hard faced disks, if either continuous hardening or striped hardening is used in the zone subject to wear.

EXAMPLE 4

Figure 14:
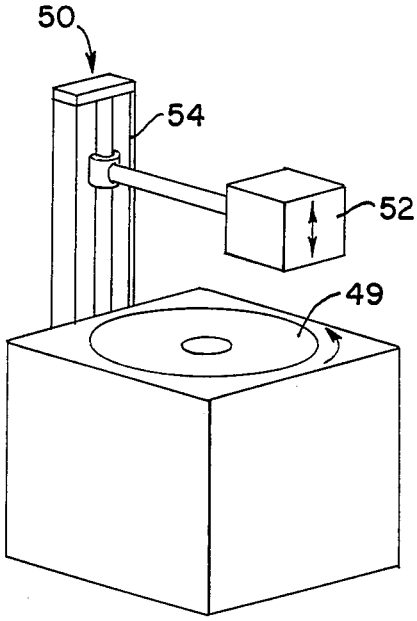
FIG. 14 is a perspective view illustrating one embodiment of the process of the present invention.

In yet another embodiment of the process of the present invention, a conventional induction-heating apparatus 50 (FIG. 14) has been used to form an induction hardened annular zone in the disk 49 as follows.

Induction hardening means 52 is mounted on a guide 54 and is raisable and lowerable along the guide 54 relative to the disk 49 for heating selected annular portions of the disk 49. When lowered, the induction-hardening means 52 induces a current in the disk 49 along the line 53. The plurality of elongated hardened zones 51 surrounding each line 53 define the hardened annular surface portion thereof. For example, after a first hardened zone is produced at a first position 62 (FIG. 6), the induction-hardening means 52 is raised above the disk 49, and the disk 49 is indexed to a second position 64. Then the induction-hardening means 52 is again lowered to the disk 49 and sufficient current is induced in the disk 49 to produce a subsequent hardened zone at the second position 64. Again, the induction-hardening means 52 is raised, the disk 49 is indexed to a third position 66, and the induction-hardening means lowered to repeat the process. The disk 49 is rapidly heated, is permitted to rapidly cool, and is indexed as above described until a major portion of the annular region 70 is heat treated in this manner.

The illustrated induction-hardening means 52 (FIG. 14) employed a high-frequency resistance type of hardening, and was done at 350–450 kilohertz.

EXAMPLE 5

Figure 11:
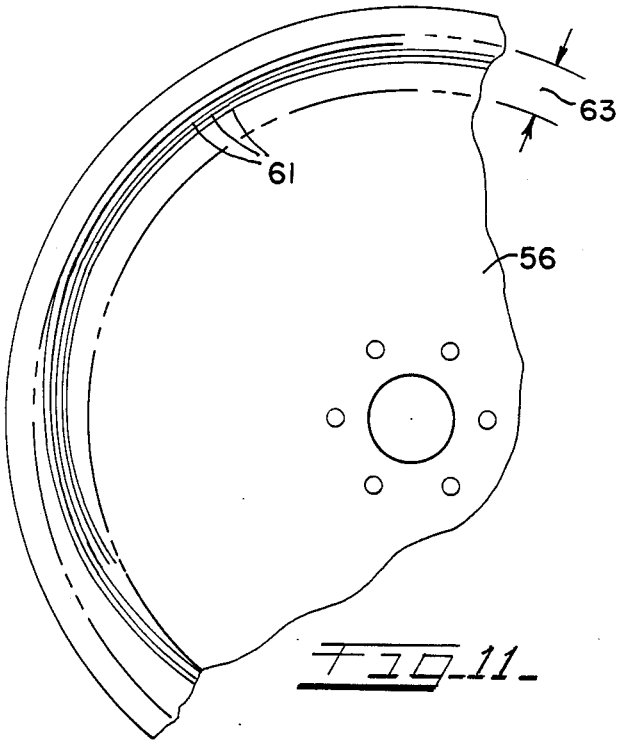
FIG. 11 is a fragmented plan view of a disk section hardened using yet another embodiment of the process of the present invention.

In the spiral-line heat-treating process of FIG. 11, ten spiral shaped lines 61, each ¼ inches wide by about 8 inches long, formed the 1-inch wide annular hardened zone 63 in the disk 56. The hardened zone 63 had a Rockwell hardness ($R_c$) of from about 64 to about 66 from the disk surface to a depth of about 0.030 inches. Each line 61 took about 0.4 seconds to form. Ten lines thus took about 4 seconds to form; and about 6–11 seconds total time was required for heating and indexing the disk 56. Thus, 10–15 seconds was required to form the 1-inch wide annular hardened zone 63 from the spiral-shaped lines 61 of FIG. 11.

What has been illustrated and described herein are preferred embodiments of a novel heat-treating process for increasing surface hardness of a heat-hardenable steel disk. Also illustrated are several disks hardened by different versions of the process of the present invention. While the process of the present invention and products thereof have been illustrated and described with reference to preferred embodiments, the present invention is not limited thereto. On the contrary, alternatives, changes or modifications may become apparent to those skilled in the art upon reading the foregoing description. Accordingly, such alternatives, changes and modifications are to be considered as forming a part of the invention insofar as they fall within the spirit and scope of the appended claims.

We claim:

1. A process for increasing surface hardness of a planar heat-hardenable steel disk, comprising:

selecting a first position on the disk surface spaced radially annularly intermediate the circumferential edge and the central portions of the disk;

rapidly heating at the first position a minor portion of the annularly intermediate disk surface in relation to the remainder of the disk so as to cause the minor portion to increase in temperature from an initial temperature to an elevated temperature ranging from about 1400 to about 1600 degrees Fahrenheit in a time period of from about 0.3 to about 0.7 seconds, and in a manner such that substantially no heat diffuses from the thus-heated portion of the disk to the remainder of the disk;

terminating the heating step in a manner so as to allow the remainder of the steel disk to serve as a heat sink thereby to rapidly cool the thus-heated portion of the disk from the elevated temperature to a temperature of less than about 1000 degrees Fahrenheit in a time period of less than about 0.75 seconds, and in a manner such that warpage of the steel disk is held to within 0.030 inches;

selecting a second position spaced from the first position on the annularly intermediate disk surface portion, and repeating the rapid-heat and heat-termination steps; and repeating the position-selection through heat-termination steps until a major portion of the annularly intermediate disk surface portion is increased in hardness to the greater value.

2. The process of claim 1 wherein the initial temperature is room temperature.

3. The process of claim 1 wherein the disk is from about 3.0 to about 3.5 millimeters thick, wherein the disk is about 14 inches in diameter, wherein the disk is selected from the group consisting of AISI 1075, 1080 and 1085 carbon steel, wherein the disk has an initial surface hardness ranging from about 42 to about 47 $R_c$, and wherein the position-selection through heat-termination steps are repeated in a manner so as to increase the surface hardness of the annularly intermediate disk surface portion to an excess of 50 $R_c$ to a depth of about 0.015 inches.

4. The process of claim 3 wherein the annularly intermediate disk surface portion is increased in hardness to an excess of about 58 $R_c$ to a depth of about 0.015 inches.

5. The process of claim 4 wherein the annularly intermediate disk surface portion is increased in hardness to a depth of about 0.030 inches.

6. A planar heat-hardened disk of about 3.0 to about 3.5 millimeters thickness, selected from AISI 1070 through 1095 carbon steel, having an annular band spaced intermediate the disk central portion and the disk circumferential edge, lines having surrounding zones of hardness defining the annular band, a major portion of the annular band having a hardness of at least about 50 $R_c$ to a depth of at least about 0.015 inches, the remainder of the disk having a hardness ranging from about 42 to about 47 $R_c$, warpage of the disk being less than 0.030 inches overall.

7. The disk of claim 6 wherein the lines are sinusoidal.

8. The disk of claim 6 wherein the lines are intersecting sinusoidal and cosinusoidal lines.

9. The disk of claim 6 wherein the lines are spiral shaped.

10. The disk of claim 6 wherein the disk is selected from the group consisting of AISI 1075, 1080 and 1085 carbon steel, and wherein a major portion of the annular band has a hardness of at least about 50 $R_c$ to a depth of at least about 0.030 inches.

11. The disk of claim 10 wherein a major portion of the annular band has a hardness of at least about 58 $R_c$ to a depth of at least about 0.030 inches.

12. The process of claim 1 wherein the last step of repeating the position-selection through heat-termination steps is repeated until substantially all of the annularly intermediate disk surface portion is increased in hardness to at least about 50 $R_c$ to a depth of at least about 0.015 inches.

13. The process of claim 12 wherein the last step is repeated until substantially all of the annularly intermediate disk surface portion is increased in hardness to at least about 58 $R_c$ to a depth of at least about 0.015 inches.

14. The process of claim 12 wherein the last step is repeated until substantially all of the annularly intermediate disk surface portion is increased in hardness to at least about 58 $R_c$ to a depth of at least about 0.030 inches.

15. The disk made by the process of claim 14.

* * * * *